United States Patent [19]

Thomas

[11] Patent Number: 4,936,382

[45] Date of Patent: Jun. 26, 1990

[54] DRIVE PIPE ADAPTOR

[75] Inventor: Ronald D. Thomas, Kingwood, Tex.

[73] Assignee: Seaboard-Arval Corporation, Houston, Tex.

[21] Appl. No.: 332,001

[22] Filed: Mar. 31, 1989

[51] Int. Cl.[5] ..... E21B 17/02; E21B 33/03

[52] U.S. Cl. ..... 166/88; 285/138

[58] Field of Search ..... 166/77.5, 85, 88, 180; 285/18, 138, 141, 145, 146

[56] References Cited

U.S. PATENT DOCUMENTS 2,485,497 10/1949 Lemley et al. ..... 166/88 X 2,689,139 9/1954 Jones et al. ..... 166/88 X 3,155,401 11/1964 Musolf ..... 166/88 X 3,405,956 10/1968 Pierce, Jr. ..... 285/141 X 4,202,410 5/1980 Quebe ..... 166/88

4,304,424 12/1981 Hansen ..... 285/404 X

*Primary Examiner*—William P. Neuder

*Attorney, Agent, or Firm*—Pravel, Gambrell, Hewitt, Kimball & Krieger

[57] ABSTRACT

An adaptor assembly for attaching equipment to a casing head by means of pipe slips or other means of attachment integrated with the assembly, and having an elastomeric seal to contain leakage.

18 Claims, 4 Drawing Sheets

DRIVE PIPE ADAPTOR

FIELD OF THE INVENTION

This invention is in the field of wellhead equipment, specifically adaptors for attaching to the upper exposed end of a drive pipe to facilitate the attachment of additional equipment to the drive pipe.

BACKGROUND

It is common practice in drilling an oil well to first install a steel pipe or casing in the borehole. This casing serves to seal off fluids from the borehole and to prevent sloughing off or caving in of the walls of the hole. The outermost casing, sometimes called a conductor pipe, is first installed and it is driven or cemented into place in the hole. It serves as a foundation or an anchor for all the subsequent drilling operations. The casinghead is the top end of the casing which protrudes above the surface. It is to the casinghead that control valves and flow pipes are attached. The conductor pipe can also be used to conduct drilling mud through loose layers of earth, such as sand.

In some applications, the conductor pipe also serves to prevent contamination of any fresh water strata which have been penetrated. When driven, conductor pipe is self-supporting, but it does not generally support its weight from the top, when it is cemented in.

When driven, the conductor pipe is installed by being driven into the ground by a pile driver. The impact of the pile driver can upset the upper end of the casing, and it usually does, causing it to be uneven and of varying thickness. A casing which is driven into the ground in this manner must be sufficiently stiff to resist the repeated compressive stress shocking caused by the pile driver. In order to provide the necessary stiffness and to resist the unevenness at the exposed end, a thicker pipe, called drive pipe, is used.

Drive pipe can have an outside diameter ranging up to 48 inches, with 26 to 30 inches being most common. Wall thickness varies from ½ to 2 inches, and roundness can vary from minus ½ to plus one percent of diameter. Usually, a flow control device, fittings and flow pipes are mounted on top of the drive pipe, in conjunction with a diverter system. This diverter system consists of various fittings and air actuated valves used to vent a low pressure gas kick in shallow wells.

Regardless of the type of equipment mounted atop a drive pipe, it is mounted to a flange on a casing head adaptor fitting that is currently welded to the drive pipe. Welding is used because the exposed end of the drive pipe casinghead is rough and uneven after being driven into the ground. Considerable machining would be required to clean up the casinghead and thread it, if a threaded fitting were used. Welding is much quicker and cheaper, so it is the method always used, at least on drive pipe casingheads.

When the casinghead adaptor is welded on the drive pipe, some disadvantages result. A joint must be preheated prior to welding and stress relieved upon completion of the weldment. Both of these operations are time consuming, using two to four hours of expensive rig time. They are also difficult to monitor and control, especially with respect to the rate of temperature rise and fall. Then, the adaptor must either be left in place and abandoned if the well is a dry hole, or it must be cut off the drive pipe and refurbished before being used again. This is time consuming and expensive. This casinghead adaptor is a heavy flanged fitting which not only supports equipment installed above it but also can support production casing suspended inside.

It would be advantageous to have an adaptor which could be mounted on a drive pipe for attachment of a diverter without the need for welding. The aforementioned technical problems associated with welding would be eliminated, and the cost of installation would be materially reduced. This would be particularly useful if the adaptor could be easily removed from a drive pipe and moved to a different well without being refurbished to any great extent. The capability of remaining on the well as the permanent casinghead is also desirable.

SUMMARY OF THE INVENTION

This invention is an adaptor, primarily for use with a diverter system, which can be mounted on the exposed end of a drive pipe, without welding. The adaptor attaches to the bald end of a drive pipe using attachment means such as a set of pipe slip segments which are driven against the surface of the drive pipe by set screws which are threaded through the wall of the adaptor. Instead of set screws, a stud driven wedge ring can be used. Instead of pipe slips, other devices can be used, such as screw actuated lock pins or eccentric dogs. The cylindrical shaped adaptor is lowered over the drive pipe until it bottoms out. The pipe slip segments or other attachment means are located circumferentially around the pipe, within the adaptor cylindrical member. These slips are driven into the pipe surface by tightening the set screws. An elastomeric seal inside the adaptor is pressed against the pipe surface by application of a pressurized fluid behind the seal or by other means, such as in the use of weight actuated seals.

DETAILED DESCRIPTION OF THE INVENTION

Figure 1:
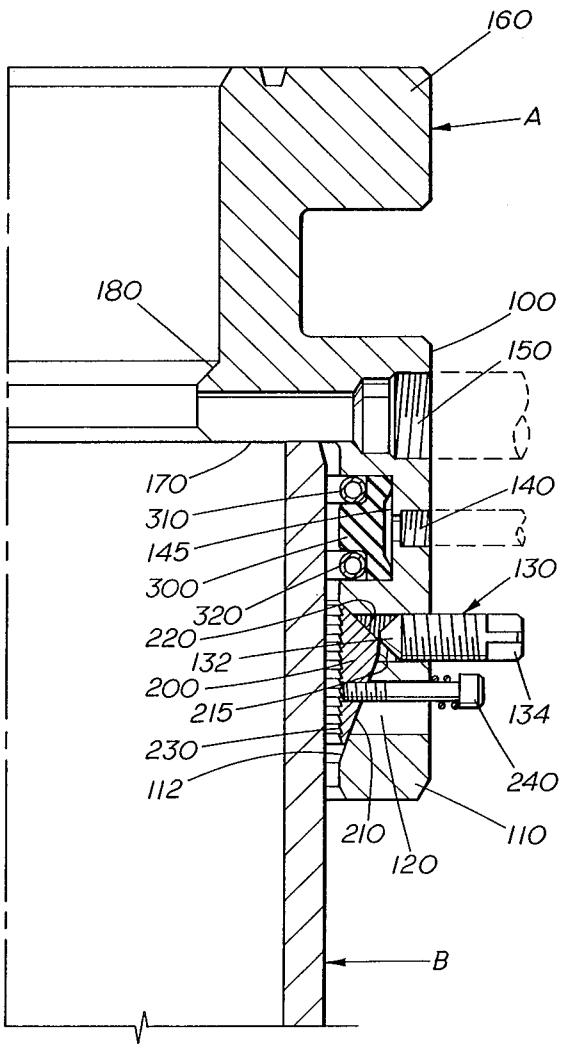
FIG. 1 is a sectional view of the adaptor of the present invention showing the drive pipe fully inserted.
Figure 7:
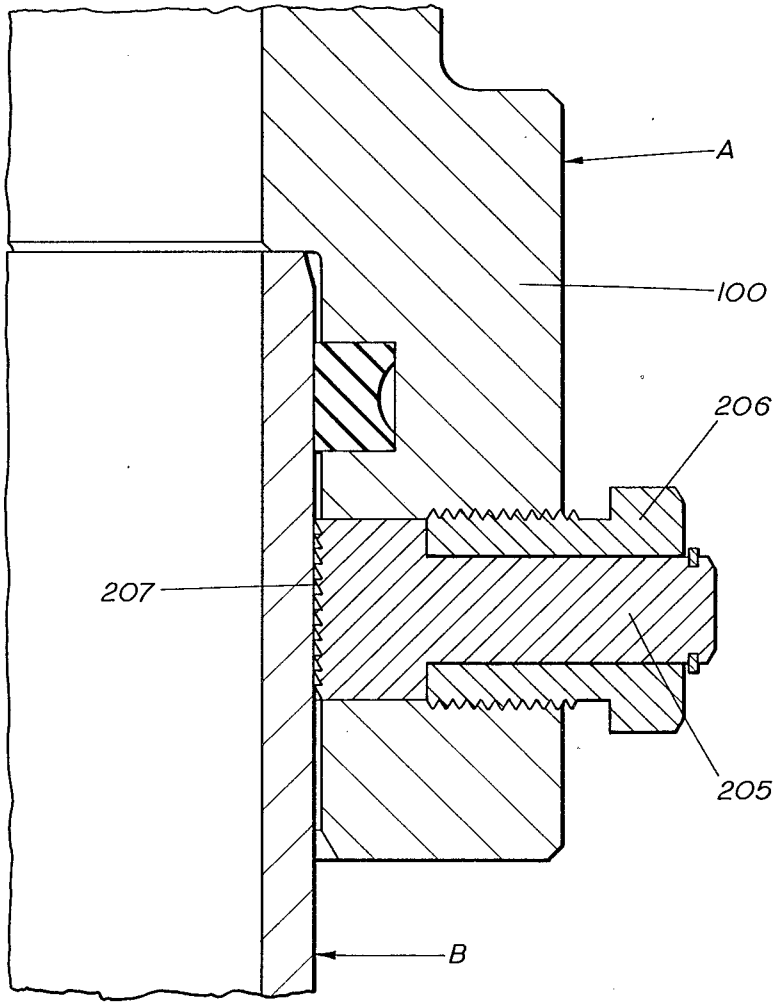
FIG. 7 is a sectional view of a fourth embodiment of the present invention, using screw actuated lock pins.

As seen in FIG. 1, diverter adaptor A has adaptor cylindrical member 100 which is a hollow cylinder extending from a selected adaptor flange 160 on its upper end to an annular tapered skirt 110 on its lower end. Adaptor flange 160 is shaped and sized to mate with the diverter or other equipment (not shown) which will be mounted atop the adaptor A. Skirt 110 has an interior annular reaction surface 112 which tapers inwardly from top to bottom. This surface 112 serves as a surface against which a plurality of pipe slip segments 200 can react as explained later. This surface is not used if other attachment means, such as the screw actuated lock pins 205, shown in FIG. 7, are used.

Skirt 110 also has a plurality of longitudinal guide slots 120 machined vertically at locations equally spaced around the entire circumference of skirt 110. These guide slots 120 guide the slip segments 200 in a vertical path as slip segments 200 engage or disengage the outer surface of drive pipe B.

Threaded through the wall of adaptor cylindrical member 100 at the top edge of reaction surface 112 are a plurality of set screws 130, each of which is located above a guide slot 120. Set screw 130 has on its outer end a head 134 outside cylindrical member 100 by means of which set screw 130 can be turned to thread substantially horizontally into or out of cylindrical member 100. On the inner end of set screw 130 is force cone 132, which is a conical surface shaped to apply force inwardly and downwardly on slip segment 200 as set screw 130 is threaded inwardly through cylindrical member 100.

A plurality of slip segments 200 are located on reaction surface 112 of skirt 110, evenly spaced around the entire circumference of skirt 110 aligned with the guide slots 120. Slip segment 200 is substantially triangular in cross-section. Outwardly facing slip reaction surface 210 tapers inwardly from a point 215 on the outer surface of slip segment 200 to the lower end of segment 200. Slip reaction surface 210 slides on skirt reaction surface 112. Outwardly facing slip drive surface 220 tapers inwardly from the same point 215 to the upper end of segment 200. Force cone 132 on set screw 130 slides on slip drive surface 220. The third side of slip segment 200 is substantially vertical gripping surface 230 which has upwardly sloping slip teeth, which press against the outer surface of drive pipe B.

Threaded into reaction surface 210 of slip segment 200 is slip segment guide pin 240. Guide pin 240 extends horizontally from slip segment 200 through guide slot 120 for the purpose of guiding slip segment 200 in a vertical path as slip segment 200 moves upwardly or downwardly on skirt reaction surface 112.

Machined into the interior surface of adaptor cylindrical member 100 above set screws 130 is an annular seal groove 145 which can communicate to the outside of cylindrical member 100 through a plurality of seal ports 140 machined through the wall of cylindrical member 100. Lying within seal groove 145 is elastomeric seal ring 300 which contacts the surface of drive pipe B around its entire circumference. Seal ring 300 can be a variety of seal types, but it is shown having upper and lower anti-extrusion members 310 and 320. Seal ports 140 are used to pressurize seal groove 145 outside or behind seal ring 300, forcing seal ring 300 into sealing contact with the outer surface of drive pipe B. Seal ports 140 can also be used to pressure test seal 300.

Figure 4:
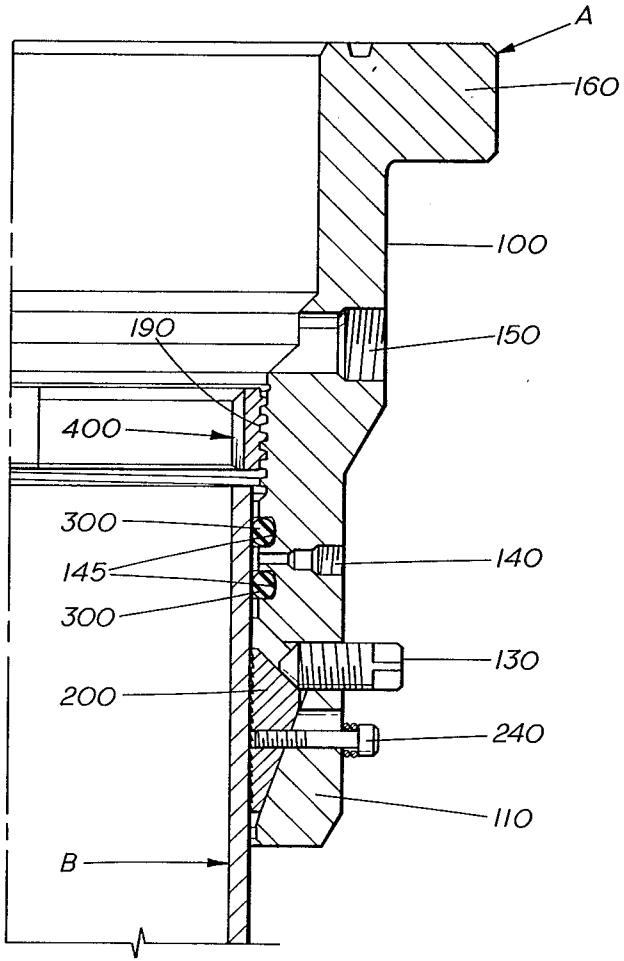
FIG. 4 is a sectional view of a second embodiment of the present invention, using a stop collar after pressure testing.

Machined into the interior surface of cylindrical member 100 above seal groove 145 is downwardly facing annular stop shoulder 170 against which the upper end of drive pipe B abuts when drive pipe B is fully inserted into diverter adaptor A. For appropriate applications, casing hanger bowl 180 can be machined into the interior surface of cylindrical member 100 above the location of stop shoulder 170. Shown in FIG. 4 is an alternate embodiment of the invention having no stop shoulder, but having instead stop collar 400 threaded into collar acme threads 190 which are machined into the interior surface of cylindrical member 100 above seal groove 145. Stop collar 400 acts as a height-adjustable stop shoulder.

Penetrating the wall of cylindrical member 100 above stop shoulder 170, or above stop collar threads 190 are a plurality of threaded outlets 150 which can be used as pressure ports or as connection points for other low pressure purposes.

The diverter adaptor is installed on the end of a drive pipe B as follows. After the drive pipe B is driven into the borehole, its upper edge is machined or filed sufficiently to remove any outwardly extending burrs or sharp edges. As shown in FIG. 1, diverter adaptor A is then lowered over the exposed end of drive pipe B until the upper end of drive pipe B bottoms out on stop shoulder 170. At this stage, seal ring 300 is still seated within seal groove 145, not contacting drive pipe B. Also, pipe slip segments 200 are near the top of their travel and free to move upwardly or downwardly because set screws 130 are fully backed out so that force cone 132 retracts within the wall of cylindrical member 100.

Figure 2:
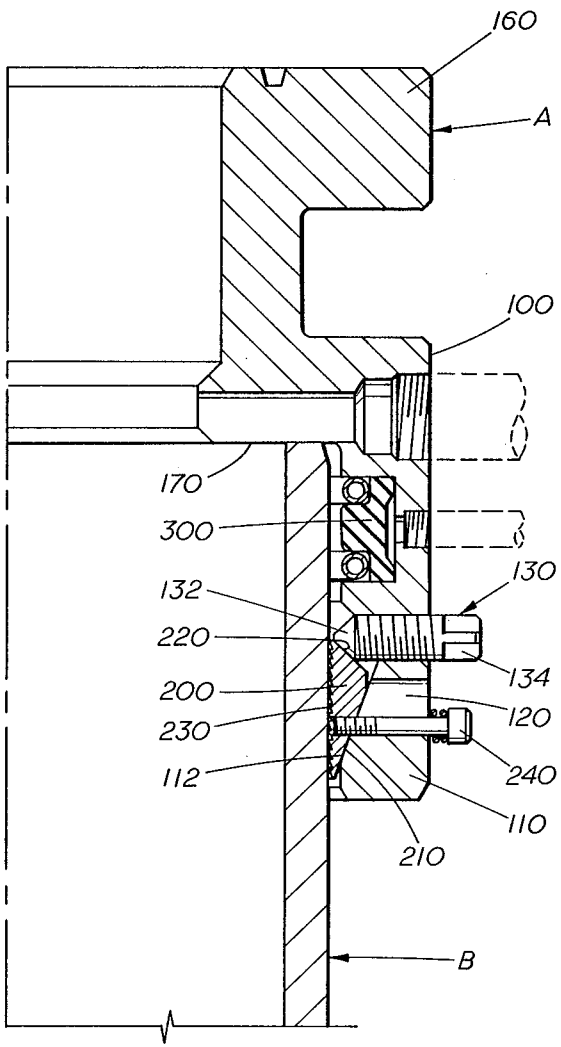
FIG. 2 is a sectional view of the adaptor of FIG. 1, showing the pipe slip segments fully engaged.

As seen in FIG. 2, set screws 130 are then incrementally threaded into cylindrical member 100 to contact slip segments 200 and then force slip segments 200 downwardly. The same principle would be used if screw actuated lock pins 205 are used, as shown in FIG. 7, instead of slip segments 200. Threaded collars 206 are screwed into cylindrical member 100 to force lock pins 205 inwardly, forcing lock pin teeth 207 into drive pipe B. The incremental threading of set screws 130 is sequenced to insure that all set screws 130 are inserted at a relatively even rate, avoiding any lateral displacement or cocking of cylindrical member 100. As set screws 130 force slip segments 200 downwardly by contact between force cones 132 and slip drive surfaces 220, force cones 132 slide along slip drive surfaces 220.

Downward movement of slip segment 200 is resisted by contact between slip reaction surface 210 and skirt reaction surface 112. Since surfaces 210 and 112 are angled relative to the downward movement of slip segments 200, skirt reaction surface 112 exerts a horizontal reaction force inwardly against slip reaction surface 210. This causes slip segment 200 to move inwardly against the outer surface of drive pipe B as slip reaction surface 210 slides down skirt reaction surface 112. This forces the upwardly canted teeth on gripping surface 230 to dig into the outer surface of drive pipe B. As slip segment 200 moves downwardly, it is constrained to a vertical path by the sliding of guide pin 240 in vertical guide slot 120.

Figure 3:
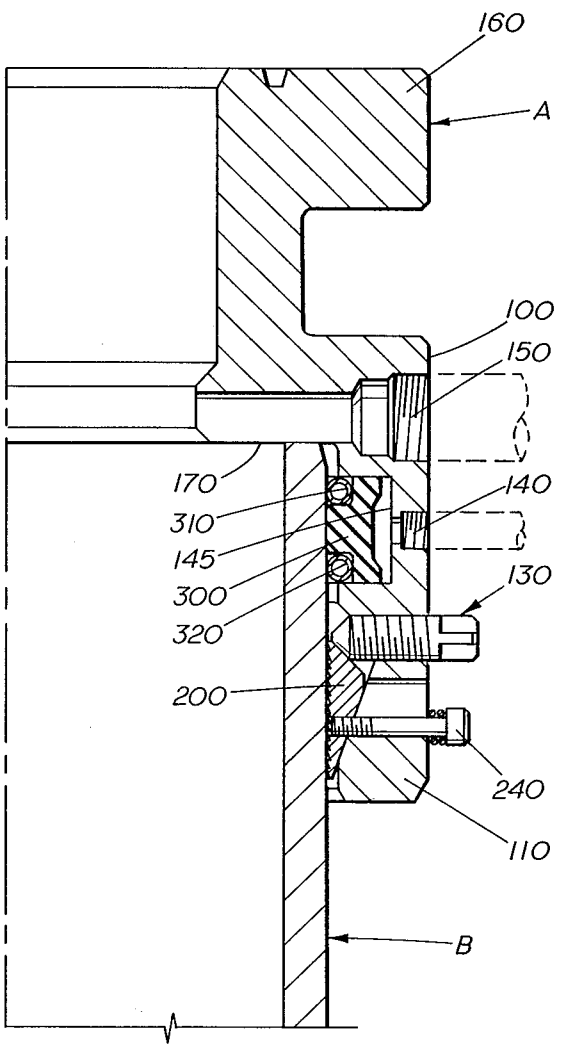
FIG. 3 is a sectional view of the adaptor of FIG. 2 showing the seal ring engaged.

Next, as shown in FIG. 3 a self-sealing fluid is introduced into seal port 140 under sufficient pressure to unseat seal ring 300 and to move seal ring 300 into intimate contact with the outer surface of drive pipe B. In the seal design shown here, anti-extrusion members 310 and 320 prevent seal ring 300 from extruding into the annular space between cylindrical member 100 and drive pipe B.

After slip segments 200 have been set against drive pipe B as described above, and after seal ring 300 has been seated against drive pipe B as described above, the effectiveness of seal 300 can be tested. This can be accomplished in a variety of ways, depending upon the style of seal being used. Generally, testing will involve the application of a pressurized fluid inside drive pipe B against a plug, accompanied by measurement of leakage past the seal.

Figure 5:
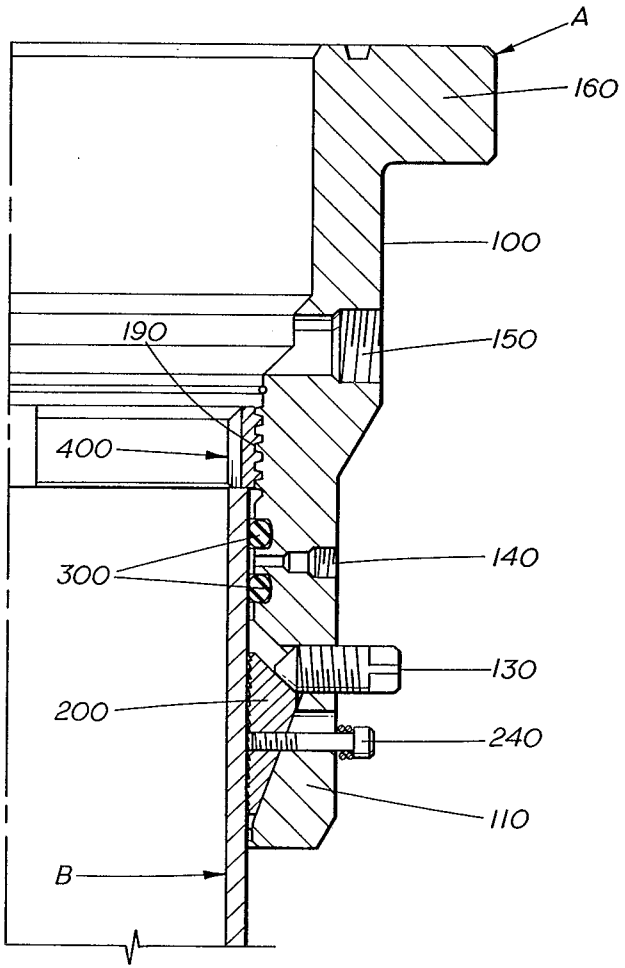
FIG. 5 is a sectional view of the adaptor of FIG. 4, showing the stop collar threaded against the drive pipe.

During testing of the seal or during pressure testing of equipment installed atop diverter adaptor A, diverter adaptor A can move slightly upwardly before slip segments 200 adequately grip drive pipe B to stop movement. This movement can be compensated for, in the alternate embodiment of the invention, as seen in FIGS. 4 and 5. In FIG. 4, drive pipe B is separated from stop collar 400 during pressure testing, by a slight upward movement of diverter adaptor A. If left in this condition, in some applications, some stability is lost, and slip segments 200 might eventually require tightening. To compensate for this upward movement, stop collar 400 is threaded down into tight contact with the upper end of drive pipe B as shown in FIG. 5. This tightening is accomplished prior to mounting any equipment on adaptor flange 160, by inserting a collar tightening tool through the top of diverter adaptor A.

Figure 6:
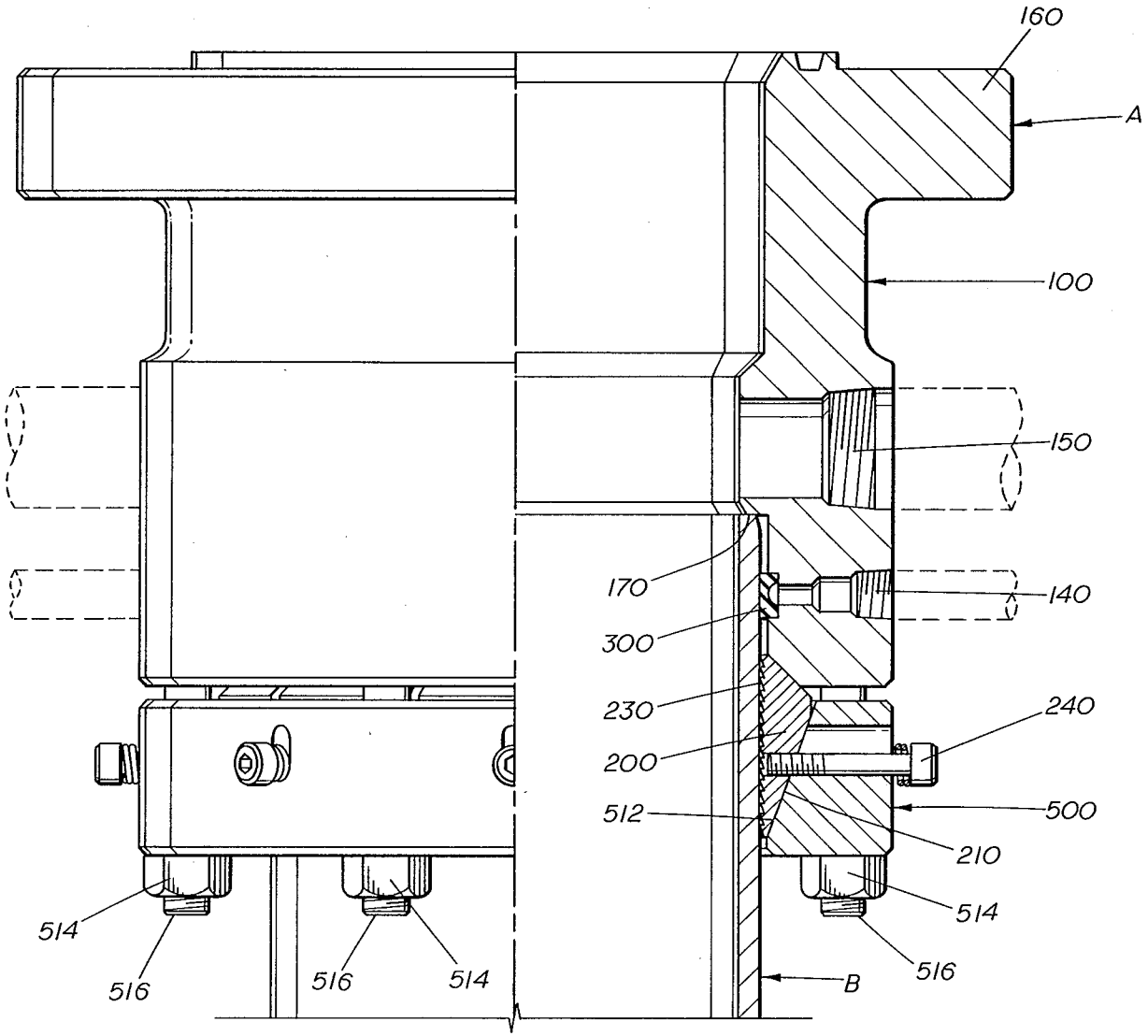
FIG. 6 is a sectional view of a third embodiment of the present invention, using a stud driven wedge ring.

A third feature of this invention, which can be incorporated if desired, is shown in FIG. 6. Instead of forcing pipe slip segments 200 against drive pipe B by tightening set screws 130, slip segments 200 can be driven inwardly by wedge ring 500, suspended beneath cylindrical member 100. Wedge ring 500 has an annular tapered drive surface 512 on its interior, against which slip reaction surface 210 lies. Wedge ring drive surface 512 tapers inwardly from top to bottom.

Wedge ring 500 is driven upwardly by tightening nuts 514 on studs 516 which extend from beneath through wedge ring 500 and into the lower end of cylindrical member 100. As nuts 514 are tightened, wedge ring 500 rises, driving slip segments 200 upwardly and inwardly until slip surface 230 contacts drive pipe B. Here again, a variety of seal types can be used, with one type being shown only for illustration purposes. In this embodiment, the tightening of wedge ring 500 can be utilized to inject a sealing compound behind the seal to drive it inwardly, or the seal itself can physically be driven inwardly by movement of the wedge ring, if desired. As a fourth feature, screw actuated lock pins 205 can be used, as shown in FIG. 7, in lieu of slip segments 200.

The description given here is illustrative only. Various modifications and variations are possible without departing from the spirit of this invention. It is intended that all such variations be encompassed in the attached claims.

I claim:

1. An adaptor for use at a wellhead on the upper end of a well pipe disposed in and extending above a wellbore, comprising:

a cylindrical member having an upper portion and a lower portion and an intermediate stop shoulder therebetween adapted to be positioned on the upper end of a well pipe;

a flange on the upper portion of said cylindrical member;

a plurality of wedge-shaped pipe attachment means attached to said cylindrical member on an interior surface of the lower portion of said cylindrical member;

means for engaging said attachment means and forcing said attachment means inwardly relative to said cylindrical member; and a seal on said interior surface of said cylindrical member between said flange and said pipe attachment means for forming a seal with the well pipe.

2. The adaptor of claim 1, wherein said attachment means are slip segments and said means for engaging comprise a plurality of set screws threaded through said cylindrical member so as to contact said slip segments.

3. The adaptor of claim 1, wherein said attachment means are screw actuated lock pins and said means for engaging comprise threaded collars on said lock pins.

4. The adaptor of claim 1, wherein said attachment means are slip segments and said means for engaging comprises a wedge ring attached to said member by threaded fasteners so that when said fasteners are tightened, said wedge ring rises to urge said slip segments upwardly and inwardly.

5. The adaptor of claim 2, further comprising:

a first annular tapered face on said interior surface of said cylindrical member where said slip segments are attached to said cylindrical member, tapered inwardly from top to bottom of said first tapered face;

a second tapered face on an outer surface of each of said slip segments, tapered inwardly from top to bottom of said face, where said segment contacts said annular tapered surface of said cylindrical member so as to move said slip segment inwardly or outwardly as said slip segment is moved downwardly or upwardly.

6. The adaptor of claim 5, further comprising:

a plurality of longitudinal slots formed vertically in a wall of said cylindrical member where said slip segments contact said cylindrical member; and a plurality of pins mounted on said second tapered faces of said slip segments and extending therefrom through said longitudinal slots for aligning said slip segments substantially with said slots as said slip segments move upwardly and downwardly.

7. The adaptor of claim 5, further comprising:

a third tapered face on said outer surface of each of said slip segments, tapered outwardly from top to bottom of said third tapered face; and a conical surface on an inwardly disposed end of each of said set screws slidably engaging said third tapered face on each of said slip segments so as to force said slip segments downwardly as said set screw is threaded inwardly into said cylindrical member.

8. The adaptor of claim 1, wherein said seal includes:

two sealing elements, a first element disposed vertically above a second element;

a test port through a wall of said cylindrical member into a space between said sealing elements for measuring a test pressure of test fluid escaping past said sealing elements from inside said cylindrical member; and a pressure port through said wall of said cylindrical member above said seal for applying pressure to a test fluid inside said member.

9. The adaptor of claim 1, further comprising means for applying sealing fluid under pressure to force said seal inwardly to seal against the well pipe inserted within said cylindrical member.

10. The adaptor of claim 1, further comprising a means for stopping inward motion of the well pipe when the well pipe is inserted longitudinally into said cylindrical member.

11. The adaptor of claim 10, wherein said stopping means comprises an annular shoulder on said interior surface of said cylindrical member, disposed above said seal.

12. The adaptor of claim 10, wherein said stopping means comprises:

annular stop threads on said interior surface of said cylindrical member, disposed above said seal; and an annular stop collar, having an inner diameter smaller than the inner diameter of said cylindrical member, threaded into said annular stop threads inside said cylindrical member.

13. An adaptor for use in at a wellhead on the upper end of a well pipe disposed in and extending above a wellbore, comprising:

a cylindrical member having an upper portion and a lower portion and an intermediate stop shoulder therebetween adapted to be positioned on the upper end of a well pipe;

a flange on the upper portion of said cylindrical member;

a plurality of pipe attachment means attached to said cylindrical member on an interior surface of the lower portion of said cylindrical member;

means for engaging said attachment means and forcing said attachment means inwardly relative to said cylindrical member, wherein said attachment means are slip segments and said means for engaging comprise a plurality of set screws threaded through said cylindrical member so as to contact said slip segments;

a seal on said interior surface of said cylindrical member between said flange and said pipe attachment means for forming a seal with the well pipe;

a first annular tapered face on said interior surface of said cylindrical member where said slip segments are attached to said cylindrical member, tapered inwardly from top to bottom of said first tapered face; and a second tapered face on an outer surface of each of said slip segments, tapered inwardly from top to bottom of said face, where said segment contacts said annular tapered surface of said cylindrical member so as to move said slip segment inwardly or outwardly as said slip segment is moved downwardly or upwardly.

14. An adaptor for use at a wellhead on the upper end of a well pipe disposed in and extending above a wellbore, comprising:

a cylindrical member having an upper portion and a lower portion and an intermediate stop shoulder therebetween adapted to be positioned on the upper end of a well pipe;

a flange on the upper portion of said cylindrical member;

a plurality of pipe attachment means attached to said cylindrical member on an interior surface of the lower portion of said cylindrical member;

means for engaging said attachment means and forcing said attachment means inwardly relative to said cylindrical member, wherein said attachment means are slip segments and said means for engaging comprise a plurality of set screws threaded through said cylindrical member so as to contact said slip segments;

a seal on said interior surface of said cylindrical member between said flange and said pipe attachment means for forming a seal with the well pipe;

a first annular tapered face on said interior surface of said cylindrical member where said slip segments are attached to said cylindrical member, tapered inwardly from top to bottom of said first tapered face;

a second tapered face on an outer surface of each of said slip segments, tapered inwardly from top to bottom of said face, where said segment contacts said annular tapered surface of said cylindrical member so as to move said slip segment inwardly or outwardly as said slip segment is moved downwardly or upwardly;

a plurality of longitudinal slots formed vertically in a wall of said cylindrical member where said slip segments contact said cylindrical member; and a plurality of pins mounted on said second tapered faces of said slip segments and extending therefrom through said longitudinal slots for aligning said slip segments substantially with said slots as said slip segments move upwardly and downwardly.

15. An adaptor for use at a wellhead on the upper end of a well pipe disposed in and extending above a wellbore, comprising:

a cylindrical member having an upper portion and a lower portion and an intermediate stop shoulder therebetween adapted to be positioned on the upper end of a well pipe;

a flange on the upper portion of said cylindrical member;

a plurality of means for attaching to the well pipe wherein said means for attaching are connected to said cylindrical member on an interior surface of the lower portion of said cylindrical member;

means for engaging and forcing said means for attaching inwardly relative to said cylindrical member;

a seal on said interior surface of said cylindrical member between said flange and said pipe attachment means for forming a seal with the well pipe; and a means for stopping inward motion of the well pipe when the well pipe is inserted longitudinally into said cylindrical member.

16. The adaptor of claim 15, wherein said means for stopping comprises an annular shoulder on said interior surface of said cylindrical member, disposed above said seal.

17. The adaptor of claim 15, wherein said means for stopping comprises:

annular stop threads on said interior surface of said cylindrical member, disposed above said seal; and an annular stop collar, having an inner diameter smaller than the inner diameter of said cylindrical member, threaded into said annular stop threads inside said cylindrical member.

18. A method for attaching selected wellhead equipment to the upper end of a well drive pipe, comprising the steps of:

placing an adaptor cylinder over an exposed end of a drive pipe so that the exposed end of the drive pipe extends past an annular seal inside said adaptor cylinder and abuts a stop means on the interior surface of said adaptor cylinder;

engaging an engaging means for force a plurality of pipe attachment means inside said adaptor cylinder inwardly against an outer surface of the drive pipe;

engaging a seal between said cylinder and the well drive pipe;

pressurizing the interior of said adaptor cylinder with a test fluid to test for leakage; and threading an annular stop collar down against the end of the drive pipe to eliminate any slack resulting from upward movement of said attachment means relative to the drive pipe during said pressurizing of the interior of said adaptor cylinder.

* * * * *

UNITED STATES PATENT AND TRADEMARK OFFICE

CERTIFICATE OF CORRECTION

PATENT NO. : 4,936,382

DATED : June 26, 1990

INVENTOR(S) : Ronald D. Thomas

It is certified that error appears in the above-identified patent and that said Letters Patent is hereby corrected as shown below:

In claim 13, column 7, line 5, cancel "in".

In claim 18, column 8, line 55, cancel "for" and insert --to--.

Signed and Sealed this

Twenty-second Day of October, 1991

*Attest:*

HARRY F. MANBECK, JR.

*Attesting Officer*

*Commissioner of Patents and Trademarks*